US005435526A

United States Patent [19]

Siegmund

[11] Patent Number: 5,435,526

[45] Date of Patent: Jul. 25, 1995

[54] COLLECTING PIT

[76] Inventor: Erwin Siegmund, 247 Oberwölbling, A-3124 Oberwölbling, Austria

[21] Appl. No.: 133,184

[22] PCT Filed: Apr. 16, 1992

[86] PCT No.: PCT/AT92/00052

§ 371 Date: Oct. 18, 1993

§ 102(e) Date: Oct. 18, 1993

[87] PCT Pub. No.: WO92/18268

PCT Pub. Date: Oct. 29, 1992

[30] Foreign Application Priority Data

Apr. 18, 1991 [AT] Austria ..... 818/91
Dec. 12, 1991 [AT] Austria ..... 2475/91

[51] Int. Cl.[6] ..... B22D 35/00

[52] U.S. Cl. ..... 266/142; 266/232; 266/275; 266/287

[58] Field of Search ..... 266/142, 143, 275, 232, 266/287; 164/128, 152, 153

[56] References Cited

U.S. PATENT DOCUMENTS 3,368,607 2/1968 Maddigan ..... 164/152
4,286,647 9/1981 Honda et al. ..... 164/153
5,145,806 9/1992 Shirakawa et al. ..... 266/227

FOREIGN PATENT DOCUMENTS 2497702 7/1982 France .
1047698 12/1958 Germany .
1508131 4/1969 Germany .
3713153 11/1988 Germany .
2056339 3/1981 United Kingdom .
9110872 7/1991 WIPO .

*Primary Examiner*—Scott Kastler
*Attorney, Agent, or Firm*—Rothwell, Figg, Ernst & Kurz

[57] ABSTRACT

A collecting pit for receiving molten metal and draining cooling water. The collecting pit (1) is equipped with a drainage layer (5, 6) formed of slag granulate, the grains of the slag granulate being interconnected by means of a binder while maintaining small channels present between these grains. The drainage layer mass also may contain thermally expanding silicic acid. The binder of the drainage layer mass may be a water-activatable heat-resistant binder containing cement, e.g. high-alumina cement. The drainage layer material exhibits a good permeability for water and vapor over a long period of time. Preferably, the drainage structure, in the bottom region of the collecting pit (1), includes a drainage layer (5) formed of slag granulate and binder and of supporting bottom plates (8), a continuous aeration space (13) being provided below the bottom plates (8) and, furthermore, wall plates (16) being attached to the side walls of the collecting pit and a continuous aeration space (17) being formed also between the wall plates (16) and the pit wall (15).

33 Claims, 4 Drawing Sheets

FIG. 3
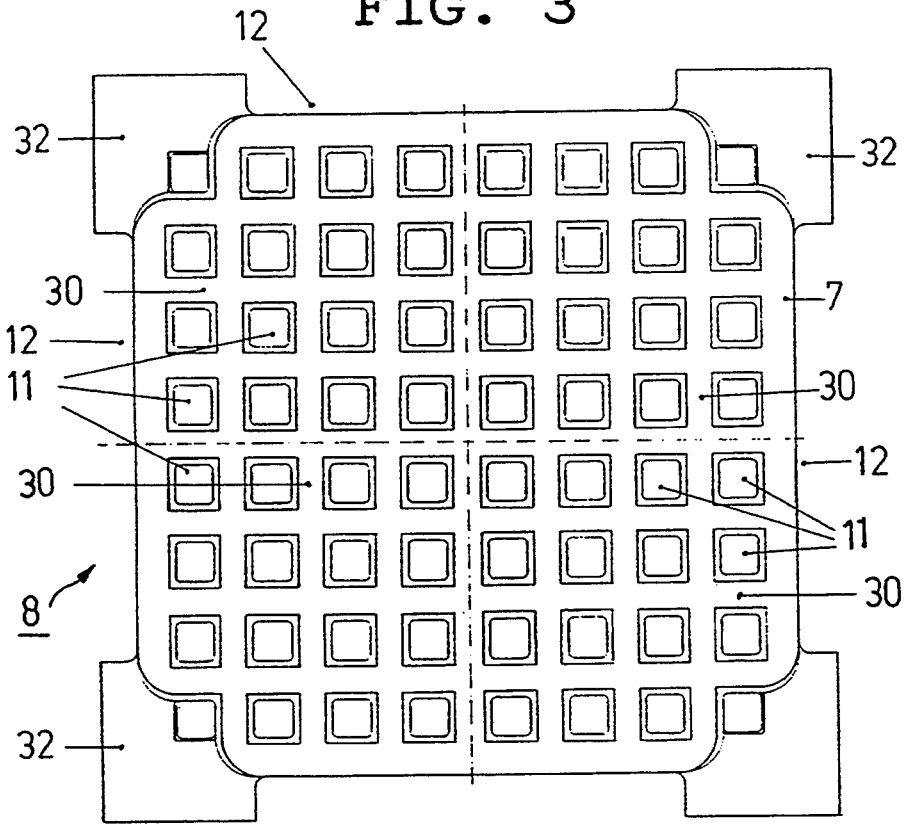
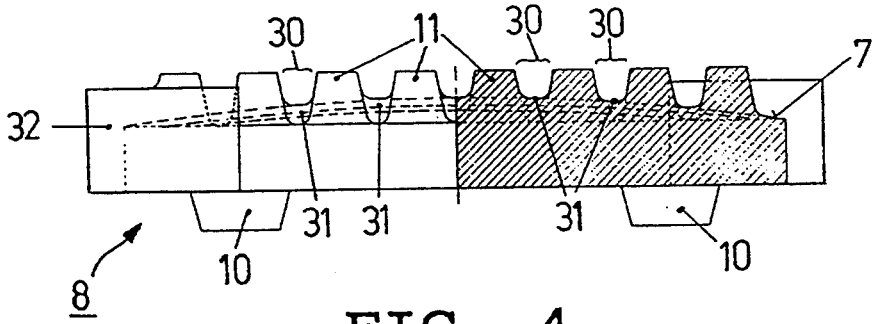
FIG. 4

COLLECTING PIT

BACKGROUND OF THE INVENTION

1. Field of the Invention

The invention relates to a collecting pit for receiving molten metal and cooling water upon the occurrence of failures in metal melting arrangements or metal holding arrangements, which collecting pit is equipped with a drainage layer formed of slag granulate, in particular cupola slag granulate, in which a plurality of small channels is provided in a pore-like distribution, through which water getting on the drainage layer runs off to an outlet, while molten metal is held back by the drainage layer.

2. Description of Relevant Art

Collecting pits of the above-mentioned type are known, in which the drainage layer is comprised of loosely filled-up fine grained slag, in particular, cupola slag, and this slag is destined to allow water getting on the drainage layer to flow off, while molten metal, in particular molten iron, is held back by this drainage layer, which causes sintering of the slag on the surface of contact within the metal. However, due to the rough ambient conditions prevailing in metal melting plants, the water permeability of such a drainage layer comprised of loosely filled-up slag is largely deteriorated after some time. In the region of such collecting pits, vibrations and shocks occur frequently, involving redensification of the filled-up slag material, thus causing the channels formed between larger slag grains to be obstructed by fine material contained in the slag, and additional fine material is formed from larger slag grains also by shocks and vibrations, accelerating and intensifying the obstruction of the channels required for water drainage. In this manner, the drainage of water through the drainage layer is strongly impeded since the water, instead of running through channels between larger slag grains, only tends to trickle through the pores of the slag materials. This not only has the disadvantage of water passing the drainage layer relatively slowly, but also has the disadvantage of relatively large amounts of water being stored in the drainage layer, such stored water leaving the drainage layer very slowly. The obstruction of the channels initially provided in the drainage layer between larger slag grains by fine material and the redensification of the slag material are still intensified in an adverse way by water frequently getting into such collecting pits in many fields of operation and plants such that the reduction of water permeability of the drainage layer occurs after a relatively short period of time. Such a decrease of the permeability of the drainage layer, like the increase in the amount of water stored in the drainage layer, considerably affects the safety function of such a collecting pit, since water present in the drainage layer may lead to explosion-like occurrences due to the formation of vapor as molten metal reaches the drainage layer.

Replacement of such a drainage layer provided in known collecting pits after its water permeability has deteriorated is complex and cumbersome, because the drainage layer provided in the bottom region of the collecting pit is covered by covering elements on which partition walls are mounted as a rule, the partitions subdividing the collecting pit into individual compartments.

SUMMARY OF THE INVENTION

It is an object of the present invention to provide a collecting pit of the initially defined kind, with which disadvantages as discussed above will be eliminated and the water permeability of the drainage layer of the collecting pit will remain largely unaffected over long periods of time even at rough ambient conditions to which the drainage layer of the collecting pit is exposed, such as the influence of shocks and vibrations, heat, dirt and frequent penetration of water, so that no safety risks will be caused by water that has previously entered the collecting pit, as molten metal flows into the collecting pit.

The collecting pit according to the invention is characterized in that the grains of the slag granulate contained in the mass forming the drainage layer are interconnected by means of a binder while maintaining intermediate spaces between these grains, thus forming a plurality of small channels, and that this mass preferably also contains thermally expandible silicic acid. By this design, the abovementioned object can be achieved in a structurally simple manner. By fixing the grains of the slag granulate contained in the mass forming the drainage layer to one another, the development of a redensification of the drainage layer due to external influences and the risk of obstruction of the small channels present between the grains of the drainage layer by fine material , through which the water can flow off, are largely eliminated even though water repeatedly gets on the drainage layer, thus exhibiting kind of a scouring effect on the grains of the material forming the drainage layer. Accordingly, the good permeability of the drainage layer for water getting on this drainage layer is preserved over extended periods of time and, even under the rough ambient conditions usually prevailing in metal melting plants, the water can quickly pass the drainage layer, and the water therefore is prevented from collecting in the drainage layer. Thus, the dangerous effects of vapor development as molten metal reaches the collecting pit are obviated over extended periods of time. The good permeability of the drainage layer, or of the material forming this layer, also enables any vapor formed to pass without impediment. The preferable addition of thermally expandible silicic acid has another positive influence on the action of the drainage layer insofar as the occlusion of the small channels due to the slag sintering upon impingement of molten metal is assisted by the expanding silicic acid.

Preferably, the binder is a water-activatable heat-resistant binder containing cement, preferably high-alumina cement, or consisting of cement, preferably high-alumina cement. High-alumina cement yields significant advantages with a view toward stabilizing the slag grains, which are mechanically sensible in the crude state, as well as with a view to forming connection sites between the slag grains, both in respect to the production of the mass and of the drainage layer and in respect to a good stability at a simultaneously good permeability and also in respect to a good sealing relative to the molten metal; this holds true, in particular, if the molten metal is iron.

Crude perlite is advantageously used as the thermally expanding silicic acid.

A preferred embodiment of the collecting pit, which offers the advantage of a simple construction, thus being easily producible at low expenditures, is characterized in that the drainage layer is a continuous layer produced and solidified in situ.

Another embodiment, by which a particularly stable structure of the drainage layer can be achieved, is characterized in that the drainage layer is comprised of shaped bodies or bricks, which, in turn, consist of a slag granulate bound by a heat-resistant binder.

As far as the grain size of the slag granulate contained in the drainage layer is concerned, the grain size ranges between 1 and 12 mm, preferably between 2 and 7 mm. Such a grain size of the slag granulate results in a favorable behavior of the drainage layer with regard to water passing as unimpeded as possible through the channels provided in the drainage layer between the grains of the slag granulate and also with regard to rapid sintering on the surface of the drainage layer as molten metal impinges on the same such that the metal cannot penetrate the drainage layer.

A drainage layer as is provided with the collecting pit according to the invention may be produced in situ in a simple manner by applying the mass destined to form the drainage layer, the mass containing slag granulate and a binder, in particular highly refractory cement, as well as, if desired, crude perlite, on the site provided for the drainage layer in the wet state and allowing it to solidify thereon.

A preferred embodiment of the collecting pit according to the invention, comprising a drainage layer arranged on bottom plates, furthermore, is characterized in that the drainage layer, in the bottom region of the collecting pit, is comprised of the drainage layer formed of slag granulate and binder and of supporting bottom plates laid to cover the bottom surface of the reception part of the collecting pit. The bottom plates are provided with outflow openings and/or laid at distances forming outflow openings, whereby a continuous aeration space is provided below the bottom plates, which space is constituted by the distance of these bottom plates from the pit bottom, and wherein a wall covering, preferably comprised of wall plates, is attached to the side walls of the collecting pit at a distance from the pit wall, the distance being provided also between the wall covering and the pit wall constituting a continuous aeration space that is upwardly open in terms of vapor permeability. By this configuration it is taken care that the bottom plates are constantly dried if moistened by water having gotten into the collecting pit, and this embodiment has the additional advantage that a cooling effect can be created in case molten metal has entered the collecting pit such that adverse thermal stresses on structural elements present in the collecting pit, such as, for instance, supporting walls, can be eliminated.

In doing so, it is favorable if the space present below the bottom plates and the space present behind the wall covering communicate with each other. Since the small channels provided in the mass forming the drainage layer are well permeable to water and also to air and since this mass also is thermally insulating, the space present below the bottom plates and the space present behind the wall covering advantageously may be at least partially filled with drainage layer mass. By the constant aeration it is cared for a rapid drying of the mass after possible moisturizing; the presence of stagnant moisture is avoided. The wall covering also may be comprised of brick walls arranged at a distance in front of the side walls of the pit space. Further improved aeration is ensured if partition walls subdividing the reception part of the collecting pit are provided with intermediate spaces leading from bottom to top, which spaces are in vapor-permeable connection with the aeration space present below the bottom plates and open upwardly so as to be vapor-permeable, providing for permanent aeration. The partition walls may be formed of plates. An embodiment that may readily be adapted to different local circumstances is characterized in that the partition walls are made of bricks of refractory material arranged in double layers, leaving free intermediate spaces for forming passages. The passages serving for aeration may be formed in a simple manner by using bricks into which passage channels have been preformed or by embedding tubes in the partition walls during laying of the bricks.

For the drainage of water from the collecting pit, it is, furthermore, advantageous if openings are provided in the partition walls on various levels from bottom, through which water can flow into the intermediate space in case of failure and which, during normal operation, assist in aerating the bottom plates and the wall plates. Advantageously, such openings are provided in the lower half, in particular, in the lower third, of the partition walls.

However, it is also possible to provide single partition walls, making them, e.g., in the form of plates supported on supporting posts arranged in the collecting pit.

It is possible to cover the drainage layer provided in the collecting pit according to the invention by perforated cover bodies similar to those provided at earlier concepts of collecting pits. This special configuration of the drainage layer in accordance with the invention offers the advantage that the good water permeability of the drainage layer is preserved to practically the same extent over extended periods of time even under unfavorable ambient conditions, such as frequent water inflow, contamination, vibrational effects and the like.

An even more advantageous embodiment is characterized in that, at least in one portion of the bottom region of the collecting pit, a drainage layer is placed on the upper side of supporting bottom plates arranged above the pit bottom at a distance therefrom and made of refractory material, and that the bottom plates, on their upper sides, preferably are provided with elevations arranged to be distributed over the upper sides of the plates in a spaced-apart manner and projecting into this drainage layer. With this embodiment, very short water flow paths can be obtained in the drainage layer, the water thus being able to pass the drainage layer relatively quickly, reaching the space below the bottom plates through outflow openings provided in the bottom plates or constituted by distances provided between the bottom plates, from which space it can freely flow off. The bottom plates are dimensioned such that they also resist the load exerted by filling of the pit with molten metal. The elevations arranged on the upper sides of the bottom plates protect the drainage layer from being compressed by mechanical load and also enable easy working when producing the drainage layer, because the thickness of the drainage layer to be produced may be determined by means of these elevations, the elevations offering a supporting facility also during the work required for the production of the drainage layer and allowing for the creation of a drainage thickness in accordance with the height of the elevations in a simple manner by appropriately spreading the drainage layer over these elevations.

It is, furthermore, favorable if the bottom plates are made of refractory concrete whose aggregate consisting of refractory material, e.g., chamotte, includes the addition of a microporous granulate. Such a configuration of the bottom plates enhances drying of the same so as to prevent more or less large particles from chipping off the bottom plates made of refractory concrete at the impingement of hot metal melt on these plates.

It is, furthermore, favorable if the elevations on the upper sides of the bottom plates are designed as stubs or ribs and the zones of the upper sides of the bottom plates located between the elevations are designed to be inclined towards outflow openings preferably provided on the edges of the bottom plates. Such a design of the bottom plates enables the simple manufacture of the same, because they are removable from the molds in a simple manner, and bottom plates designed in this manner exhibit good properties in terms of water drainage. The water drainage is enhanced even more if the zones of the upper sides of the bottom plates located between the elevations are designed in the manner of flutes having concavely curved bottoms and leading towards outflow openings. The curved bottoms of the flutes also render feasible the easy removal of drainage layer material present in these flutes, if the drainage layer is to be replaced.

With regard to positioning the outflow openings in the region of the bottom plates, a preferred embodiment provides for outflow openings on the edges of the bottom plates, which outflow openings preferably are designed as edge recesses. Hence follows simple shaping, enabling the water to be readily drained, an additional advantage being that edge recesses are easy to make into bottom plates and also will not noticeably reduce the rigidity or supporting strength of such bottom plates.

In respect of the water outflow from the collecting pit, a preferred embodiment of the same is characterized in that partition walls each comprised of a double wall with an intermediate space therebetween are arranged in the collecting pit, the intermediate spaces registering with the outflow openings on the edges of the bottom plates. With this embodiment, effective aeration is feasible not only in the region of the bottom plates and wall plates, but also in the region of the partition walls of the collecting pit, whereby accelerated cooling of molten metal received in the collecting pit is ensured.

Another embodiment of the collecting pit according to the invention, which likewise is structurally simple and favorable with regard to drainage action and metal melt reception, is characterized in that, for subdividing the collecting pit, tubes of perforated plate are perpendicularly mounted in the collecting pit one beside the other in a spaced apart manner, the intermediate spaces between the tubes being filled with drainage layer mass. In doing so, it is advantageous if the upper end of the tubes are covered by lids of meltable material.

If the collecting pit according to the invention comprises an inlet part extending to below the metal melting or holding arrangement and serving to conduct molten metal into the reception part of the collecting pit, it is favorable if, in addition to one or several drainage outlets being provided below the bottom of a reception part of the collecting pit destined for receiving molten metal, at least one further drainage outlet be provided in the region of transition from an inlet part of the collecting pit into the reception part of the same, through which further drainage outlet water coming from the inlet part is drained prior to reaching the reception part of the collecting pit. In this manner, at least a major portion of the water that gets into the inlet part of the collecting pit can be drained prior to reaching the reception part of the pit such that as little water as possible will be conducted to the drainage layer provided in the reception part of the collecting pit, thus, again, enhancing safety.

BRIEF DESCRIPTION OF THE DRAWINGS

In the following, the invention will be explained in more detail by way of examples illustrated in the drawing. In the drawing:

FIG. 3 is a top view on a bottom plate used with such a collecting pit, FIG. 4 illustrates this bottom plate partially in side view and partially in section along line IV—IV of FIG. 3.

DETAILED DESCRIPTION OF PREFERRED EMBODIMENTS

Figure 1:
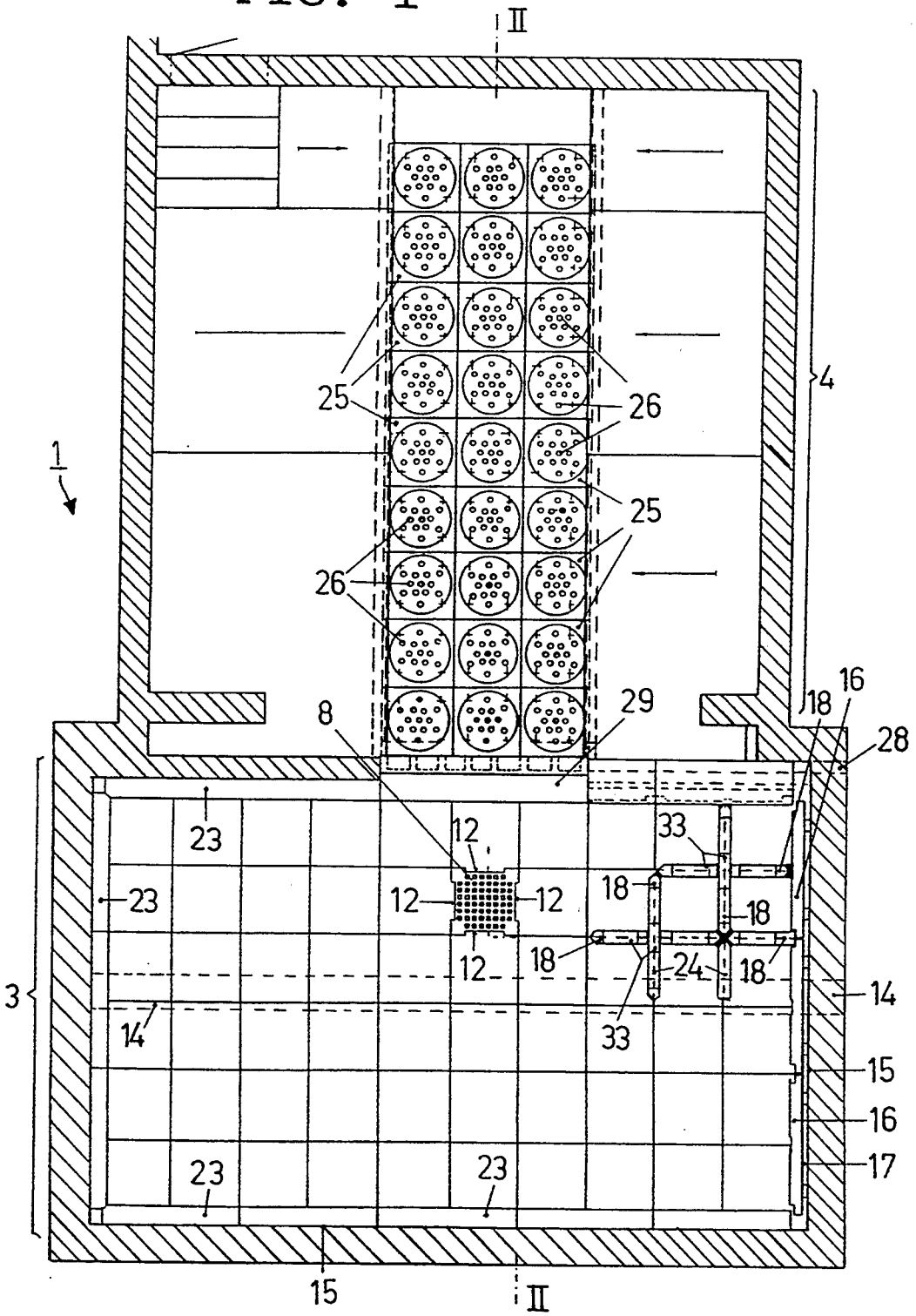
FIG. 1 is a top view on an example of a collecting pit designed according to the invention, partially sectioned horizontally along line I—I of FIG. 2.
Figure 2:
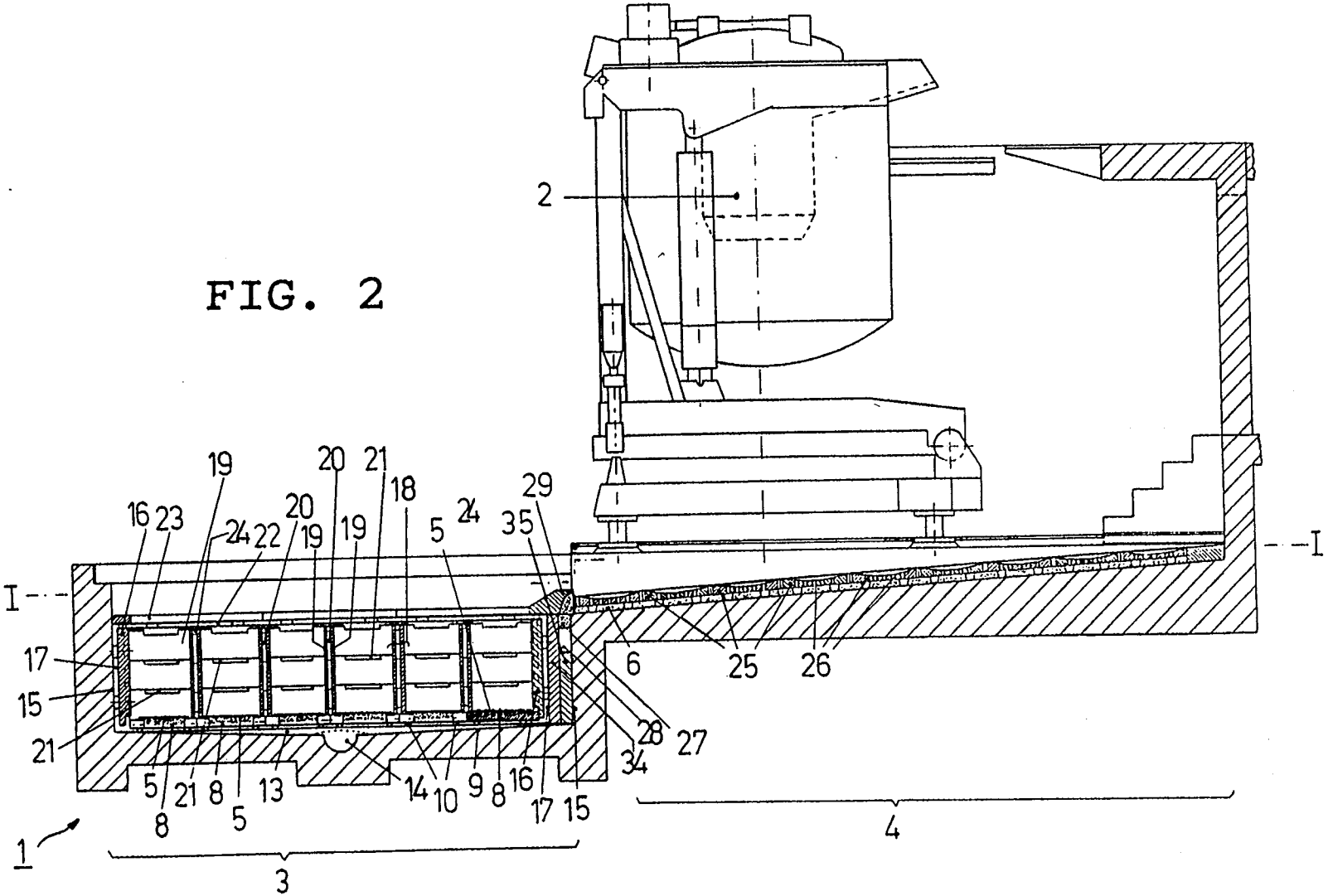
FIG. 2 illustrates this collecting pit in a section laid along line II—II of FIG. 1.

The collecting pit 1 represented in FIGS. 1 and 2 is destined to receive molten metal that may emerge from a metal melting arrangement or a metal holding arrangement 2 in case of failure. The collecting pit 1 is provided with drainage for rapidly draining water entering the pit in order that no appreciable amounts of water are present in the collecting pit at the inflow of molten metal into the collecting pit, which water might lead to the dangerous formation of vapor at the inflow of molten metal.

The collecting pit 1 comprises a reception part 3 and an inlet part 4, the inlet part 4 conducting metal melt emerging from the metal melting or holding arrangement 2 in case of failure into the reception part 3 and also carrying away possibly emerging cooling water or other water. To drain the water, drainage is provided both in the reception part 3 and in the inlet part 4 of the collecting pit 1. To this end, a drainage layer 5 is provided in the reception part 3 and a drainage layer 6 is provided in the inlet part 4, these drainage layers having a plurality of small channels distributed in pore-like fashion throughout the layers, through which the water getting on the drainage layers runs off quickly. The drainage layers 5, 6 are comprised of a slag granulate, preferably a cupola slag granulate, the grains of the slag granulate being interconnected by means of a binder while maintaining a plurality of intermediate spaces between these grains forming a plurality of small channels. Preferably, cement, in particular, highly refractory high-alumina cement, is used as the binder. In this manner, the drainage layers have mechanically stable structures such that the small channels extending between the grains of the slag granulates remain permeable over relatively long periods of time even though these layers are subjected to vibrations, frequent water showers and the like. If molten metal impinges on such a drainage layer, the slag granulate immediately sinters together on the drainage layer surface facing the molten metal, the drainage layer getting impermeable by this sintering together and preventing the molten metal from penetrating into this layer. It is advantageous if the mass forming the drainage layer also contains thermally expanding silicic acid; preferably, crude perlite is added to the mass for this purpose. The composition of the mass used for forming the drainage layers may be varied within relatively large ranges. The amount of the slag granulate is 50% by weight at least and may reach over 90% by weight. As the binder, a water-activatable heat-resistant binder may be used, preferably cement, in particular, refractory high-alumina cement; the amount of binder ranges from 5 to 20% by weight. In practice, the use of a mass containing 60 to 70% by weight of slag granulate having a grain size ranging from 1.5 to 7 mm, 20 to 30% by weight of crude perlite having a grain size ranging from 1 to 3 mm, and 10 to 20% by weight of highly refractory high-alumina cement for the production of the drainage layers has yielded favorable results. Such a mass, in the moist state, may simply be introduced into the space provided for the drainage layer and spread in layers such that a drainage layer formed in situ will be obtained upon solidification of the binder. However, it is also possible to form molded bodies or bricks from such a mass and to lay the same one beside the other to form a drainage layer.

The drainage layer 5 in the reception part 3 of the collecting pit 1 rests on the upper surfaces 7 of bottom plates 8 arranged above the pit bottom 9 at a distance thereof. The distance of the bottom plates 8 from the pit bottom 9 is provided by means of feet 10 molded to the lower side of the bottom plates 8; however, such a distance may also be created by any other supports, spacers or the like. The bottom plates 8 are designed to be supporting so as to withstand the load exerted by the molten metal flowing into the collecting pit, these bottom plates 8 being made of refractory material.

On the upper sides 7 of the bottom plates 8, elevations 11 are provided, which are arranged to be distributed over the plate surfaces and project into the drainage layer 5. The height of these elevations 11 preferably corresponds to the layer thickness of the drainage layer. However, the drainage layer also may be thicker, and in special cases even thinner, than the height of these elevations 11. The elevations 11 constitute supports in the drainage layer, facilitating manipulations with a view to observing a predetermined thickness of this layer during production. In the top view depicted in FIG. 1, the bottom plates are covered by the drainage layer, one of these bottom plates 8 being represented without superimposed drainage layer for illustrative purposes.

In FIG. 2, one of the bottom plates 8 and the drainage layer material located between the elevations 11 are illustrated in section; a number of further bottom plates 8 appear in side view due to a slightly offset position of the planes of section.

On the edges of the bottom plates 8, outflow openings 12 are formed, which enable the passage of water into the space 13 provided between the bottom plates 8 and the pit bottom 9. Water that gets into the reception part 3 of the collecting pit 1 on the drainage layer 5, thus, can pass the drainage layer by a relatively short flow path within this layer and, through the outflow openings 12, can reach the space 13 and, from there, the outlet 14. The quick passage of water through the drainage layer 5 is assisted by making the zones of the surface of the bottom plates 8 located between the elevations 11 to be inclined towards the outflow openings 12. Such outflow openings also may be placed farther inwardly in these bottom plates instead of being provided on the edges of the bottom plates.

Wall plates 16 made of refractory material are attached to the side walls of the reception part 3 of the collecting pit 1 at a distance from the pit wall 15. Thus, a space 17 is provided between the wall plates 16 and the pit wall 15. Through the spaces 13 and 17, which are provided between the bottom plates 8 and the pit bottom 9, and between the wall plates 16 and the pit wall 15, respectively, a thermal insulation is created, which inhibits the thermal transmission towards the pit bottom 9 and towards the pit wall 15 in the case of molten metal flowing into the reception part 3, such that heating of the pit bottom 9 and of the pit wall 15 thereby can be kept low. Such heating can be reduced even further by designing the spaces 13 and 17 as continuous aeration spaces, taking care for ventilation through these spaces; due to a constant aeration of these spaces, it is possible to carry away moisture from the bottom plates 8 and from the wall plates 16 such that these plates will dry relatively quickly after having become moist. This is of importance, because moist plates of refractory material get a chipped off surface appearance if highly heated abruptly by the molten metal flowing thereon. If desired, an intense stream of air may be conducted through the spaces 13, 17 by appropriate fans or the like, if said spaces are configured as continuous aeration spaces, which air stream effectively assists in cooling the molten metal flowing into the collecting pit.

The withdrawal of moisture from the bottom and wall plates, furthermore, may be assisted by admixing a microporous granulate, in particular a slag granulate, to the material of which these plates are made. Through the thus formed pores, moisture can escape from the refractory material more readily. Advantageously, refractory concrete comprised of aggregates consisting of refractory material, e.g., chamotte, a microporous granulate and refractory cement may be used as the refractory material for the bottom and wall plates. Bottom plates of such refractory material having a composition of about 40 to 50% by weight of chamotte, 20 to 30% by weight of slag granulate and/or expanded perlite and 20 to 30% by weight of high-alumina cement have shown suitable properties in practice. The slag granulate or other additives resulting in high pore volumes enhance drying of the bottom plates.

Partition walls 18 advantageously designed with double walls are provided in the reception part 3 of the collecting pit 1 and are comprised of partition wall plates 19 arranged at a distance from one another, the intermediate space 20 between the partition wall plates 19 registering with the outflow openings 12 on the edges of the bottom plates 8. The intermediate space 20 between the partition wall plates 19 creates a stack effect assisting in the aeration of space 13. Cooling of the metal melt flowing into the collecting pit can be further intensified by an intense air stream produced by fans or similar means in the intermediate space 20.

In the partition walls 18, openings 21 are provided on different levels from the bottom, through which water may flow into the intermediate space 20 in case of failure and which assist in the aeration of the bottom plates and of the wall plates during normal operation. Water that gets into the openings 21 in case of failure shortly reaches space 13 through the outflow openings 12 and, further on, the outlet 14.

With a view to simple handling during installation and possible repair work, the partition walls 18 may be combined to wall pairs 33 as illustrated, extending at right angles to each other and connected with each other to form a cross-like structure to be readily manipulated and positioned without any problem by means of a hoist, without requiring lateral support. For reasons of simplicity, only two wall pairs 33 and a partition wall 18 additionally provided on the edge of the collecting pit are depicted in FIG. 1; however, as is apparent from FIG. 2, the partition walls 18, which are united to wall pairs 33 to the major extent, are distributed over the entire reception part 3 of the collecting pit.

The upper end of space 17 present behind the wall plates 16 is covered by cover plates 23 leaving free aeration openings 22 and, thus, is protected against the entry of dirt and other foreign bodies. In an analogous manner, the upper end of the intermediate space 20 of the partition walls 18 is protected by ledges 24. On the right-hand edge of the reception part of the collecting pit, the cover plates 23 have been omitted in order to render visible the arrangement of the wall plates 16 at a distance from the pit wall 15.

The drainage layer 6 provided in the inlet part 4 is covered on its upper surface by cover plates 25 provided with holes 26, through which water may get into the drainage layer 6. The water flows along the drainage layer 6, through a passage 27 filled with drainage layer material, to an outlet 28 provided on the side of the reception part 3 of the collecting pit 1. Molten metal emerging from the metal melting or holding arrangement 2 in case of failure and unable to penetrate into the drainage layer due to the above-mentioned sintering of the surface of the same will flow on the cover plates 25 together forming a downwardly inclined surface, to the reception part 3 of the collecting pit 1 and, passing over a crown block 29, into the reception part of the collecting pit. On the pit wall 15 facing the inlet part 4, the outlet 28 is defined by a partition wall 34 and an outlet bottom wall 35. On this side of the reception part 3 of the collecting pit, the wall plates 16 are arranged in front of the partition wall 34, leaving free a space 17.

The bottom plates provided with the embodiment of a collecting pit illustrated in FIGS. 1 and 2 in the reception part 3 of the same are illustrated on a larger scale and in more detail in FIGS. 3 and 4. The elevations 11 provided on the upper sides 7 of the bottom plates 8 are designed as stubs similar to truncated pyramids and are arranged to be distributed over the upper sides 7 of the bottom plates 8 in a checkered manner. The arrangement and configuration of these elevations may be varied in various manners; thus, it is, for instance, possible to design the elevations as ribs, which ribs may extend over the upper side of the bottom plates, e.g., parallel or radially from the center towards the edge of the bottom plates. In the embodiment illustrated, the bottom plates 8 are provided with outflow openings 12 on their edges, which outflow openings may be designed as edge recesses. The outflow openings also may be designed as passage holes; no molded-in outflow openings are, however, required if a distance is each provided between neighboring bottom plates when laying the bottom plates.

The zones 30 of the upper sides 7 of the bottom plates 8 provided between the elevations 11 are designed to be inclined towards the outflow openings 12. These zones 30 are shaped like flutes having concavely curved bottoms 31. Such shaping is advantageous in various respects; for one part, release of the bottom plates from the molds is facilitated during the production of the same, and, for the other part, flowing off of the water in the drainage layer to the outflow openings is encouraged and removal of the drainage layer material from the zones 30 provided between the elevations 11 is facilitated in case the drainage layer 5 is to be replaced. Corner posts 32 are molded to the edges of the bottom plates for supporting the partition walls 18.

The structure of the collecting pit according to the invention enables effective drainage while requiring relatively little space. Thus, it is, for instance, possible to utilize an overall height of the space 13 provided below the bottom plates 8 themselves , of the bottom plates 8 and of the drainage layer 5 of about 12 to 15 cm (at a bottom plate size of about 60×60 cm, which constitutes an essential advantage).

Figure 6:
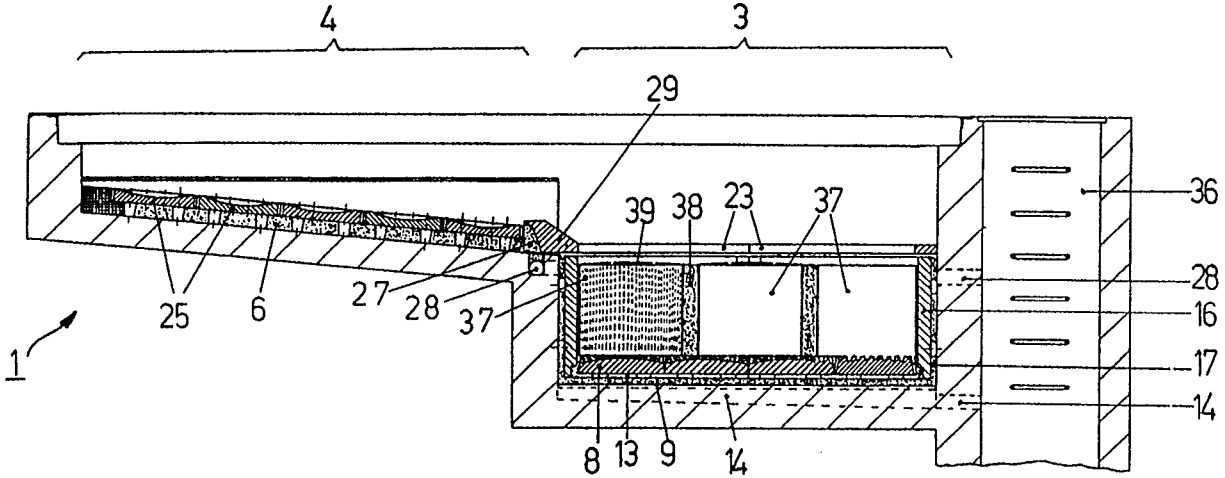
FIG. 6 illustrates this collecting pit in section along line VI—VI of FIG. 5.
Figure 5:
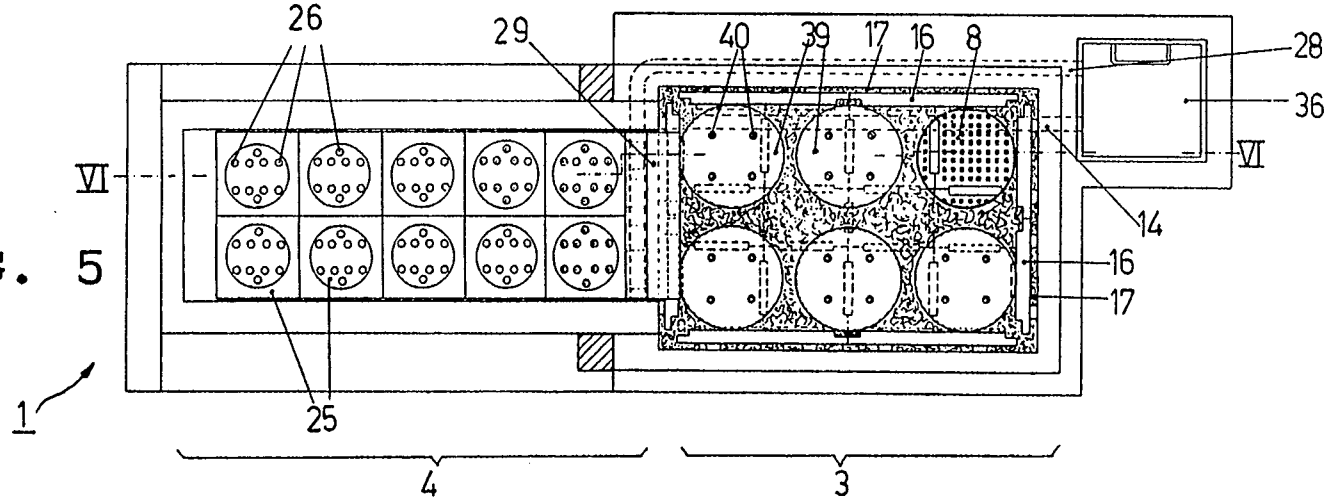
FIG. 5 is another example of a collecting pit designed in accordance with the invention, in top view.

With the collecting pit 1 represented in FIGS. 5 and 6, the inlet part 4 is formed in a manner analogous to the embodiment illustrated in FIGS. 1 and 2, having a drainage layer 6 covered by cover plates 25; the cover plates 25 have holes 26; a passage 27 follows upon the drainage layer 6, leading to the outlet 28, which, in turn, runs into a water shaft 36. Molten metal gets into the reception part 3 of the collecting pit via the crown block 29. In the reception part 3, bottom plates 8 are arranged on the pit bottom 9 at a distance above this bottom. The drainage layer 5 is placed on the bottom plates 8. From the space 13 below the bottom plates 8; the outflow 14 leads into the water shaft 36. In contrast to the example according to FIGS. 1 and 2, drainage material is provided in the space 13 and, furthermore, also in the space 17 between the wall plates 16 and the pit wall 15 with the embodiment according to FIGS. 5 and 6. A certain aeration and drying effect is achieved also in this case. It is also possible to position the drainage layer in the reception part 3 only below the bottom plates. In FIG. 5 the cover plates 23 have been removed to make the wall plates 16 and the space 17 visible. To subdivide the space of the reception part 3, tubes 37 of perforated plate are perpendicularly mounted one beside the other in a spaced-apart manner. The intermediate spaces between the tubes 37 are filled with drainage layer mass. The upper ends of the tubes 37 are covered by lids 39 of metal plate, in which vents 40 are provided. Such a lid has been removed in FIG. 5, and the drainage layer has been removed from the bottom end of the tube associated with this lid such that the bottom plates located therebelow, which have different sizes in the instant case, are visible. Constant aeration and drying of the drainage material in the intermediate space 38 is ensured through the holes of the tubes 37 of perforated plate. If molten metal flows into the reception part 3 of the collecting pit, the lids 39 will melt and the melt will get into the spaces formed by the tubes 37, where it solidifies.

I claim:

1. A collecting pit for receiving molten metal and cooling water upon the occurrence of a failure in a metal melting arrangement or a metal holding arrangement, the collecting pit comprising:

a drainage layer including a slag granulate, the slag granulate having a plurality of small channels provided therein, the plurality of small channels being distributed throughout the slag granulate to permit water to flow through the drainage layer and away from the collecting pit to an outlet;

said drainage layer including a binder which interconnects grains of the slag granulate to maintain intermediate spaces therebetween and form said plurality of small channels through which the water drains; and wherein said drainage layer prevents passage of molten metal therethrough and said slag granulate includes a portion which becomes sintered upon contact with the molten metal to form a sintered layer which is impermeable to the molten metal;

whereby water passing into the collecting pit is drained therefrom through the channels and into the outlet, and the formation of said sintered layer prevents the passage of molten metal through the drainage layer thereby preventing the molten metal received in the collecting pit from contacting the water received in the collecting pit.

2. A collecting pit according to claim 1, wherein said slag granulate is cupola slag granulate.

3. A collecting pit according to claim 1, wherein the drainage layer also contains thermally expanding silicic acid.

4. A collecting pit according to claim 1, wherein the binder is a water-activatable heat-resistant binder which at least partially contains cement.

5. A collecting pit according to claim 4, wherein the binder at least partially contains high-alumina cement.

6. A collecting pit according to claim 3, wherein crude perlite is added as said thermally expanding silicic acid.

7. A collecting pit according to claim 4, wherein the drainage layer is formed in situ and solidified.

8. A collecting pit according to claim 1, wherein the drainage layer is comprised of shaped bodies or bricks, which, in turn, consist of a slag granulate bound by a heat-resistant binder.

9. A collecting pit according to claim 1, wherein the grain size of the slag granulate is in a range from about 1 mm to about 12 mm.

10. A collecting pit according to claim 7, wherein the grain size of the slag granulate is in a range from about 1 mm to about 12 mm.

11. A collecting pit according to either claim 9 or 10, wherein the grain size of the slag granulate is in a range from about 2 mm to about 7 mm.

12. A collecting pit according to claim 1, further comprising a plurality of supporting bottom plates disposed to cover a bottom surface of a reception part of the collecting pit, said bottom plates being provided with outflow openings and a first continuous aeration space being provided below the bottom plates, the first aeration space defined by the distance of the bottom plates from the pit bottom surface, and a wall covering attached to side walls of the collecting pit at a distance from the pit side walls, the distance between the wall covering and the pit side walls defining a second continuous aeration space the upper end of which is vapor permeable.

13. A collecting pit according to claim 7, further comprising a plurality of supporting bottom plates disposed to cover a bottom surface of a reception part of the collecting pit, said bottom plates being provided with outflow openings and a first continuous aeration space being provided below the bottom plates, the first aeration space defined by the distance of the bottom plates from the pit bottom surface, and a wall covering attached to side walls of the collecting pit at a distance from the pit side walls, the distance between the wall covering and the pit side walls defining a second continuous aeration space the upper end of which is vapor permeable.

14. A collecting pit according to either claim 12 or 13, wherein said bottom plates are laid at distances that form outflow openings between adjacent bottom plates.

15. A collecting pit according to either claim 12 or 13, wherein said wall covering is comprised of wall plates.

16. A collecting pit according to either claim 12 or 13, wherein the first aeration space present below the bottom plates and the second aeration space present behind the wall covering communicate with each other.

17. A collecting pit according to either claim 12 or 13, wherein the first aeration space present below the bottom plates and the second aeration space present behind the wall covering at least partially are filled with the drainage layer including slag granulate and a binder.

18. A collecting pit according to either claim 12 or 13, wherein partition walls subdivide a reception part of the collecting pit and are provided with intermediate spaces leading from a bottom to a top of the partition walls, which intermediate spaces are in vapor-permeable connection at their lower end with the first aeration space present below the bottom plates and are open at their upper end so as to be vapor-permeable and provide for permanent aeration.

19. A collecting pit according to either claim 12 or 13, wherein partition walls subdivide a reception part of the collecting pit and are provided with intermediate spaces leading from a bottom to a top of the partition walls, which intermediate spaces are in vapor-permeable connection at their lower end with the first aeration space present below the bottom plates and are open at the upper end so as to be vapor-permeable and provide for permanent aeration, and wherein said partition walls are made of bricks of refractory material arranged in double layers which define the intermediate spaces.

20. A collecting pit according to either claim 12 or 13, wherein partition walls subdivide a reception part of the collecting pit and are provided with intermediate spaces leading from a bottom to a top of the partition walls, which intermediate spaces are in vapor-permeable connection at their lower end with the first aeration space present below the bottom plates and are open at their upper end so as to be vapor-permeable and provide for permanent aeration, and wherein openings are provided in the partition walls on different levels from the bottom thereof through which water can flow into the intermediate spaces if necessary and which, during normal operation, assist in aerating the bottom plates and the wall plates.

21. A collecting pit according to claim 1, wherein in at least one portion of a bottom region of the collecting pit supporting bottom plates are arranged above the pit bottom region a selected distance, the plates being made of refractory material, and the drainage layer is placed on an upper side of the plates.

22. A collecting pit according to either claim 12 or 13, wherein in at least in one portion of a bottom region of the collecting pit the drainage layer is placed on the upper side of the supporting bottom plates which are arranged above the pit bottom surface at a distance therefrom, the plates being made of refractory material.

23. A collecting pit according to claim 21, wherein the bottom plates, on their upper sides, are provided with elevations distributed over the upper sides of the plates in a spaced-apart manner, the elevations projecting into the drainage layer.

24. collecting pit according to claim 23, wherein the height of the elevations provided on the upper sides of the bottom plates is substantially equal to the thickness of the drainage layer.

25. A collecting pit according to claim 21, wherein the bottom plates are made of refractory concrete whose aggregate consists of refractory material and includes the addition of a microporous granulate.

26. A collecting pit according to claim 24, wherein the bottom plates are made of refractory concrete whose aggregate consists of refractory material and includes the addition of a microporous granulate.

27. A collecting pit according to claim 23, wherein the elevations on the upper sides of the bottom plates are designed as stubs or ribs and the upper sides of the bottom plates have zones located between the elevations and inclined toward outflow openings.

28. A collecting pit according to claim 27, wherein the zones of the upper sides of the bottom plates located between the elevations are flutes having concavely curved bottoms and leading toward the outflow openings.

29. A collecting pit according to claim 28, wherein the outflow openings are provided on edges of the bottom plates.

30. A collecting pit according to claim 1, further including partition walls each comprised of a double wall with an intermediate space formed therebetween arranged in the collecting pit, the intermediate spaces registering with outflow openings provided on edges of a plurality of bottom plates which are positioned on a bottom of the collecting pit.

31. A collecting pit according to claim 1, wherein the collecting pit is subdivided by tubes of perforated plate perpendicularly mounted in the collecting pit one beside the other in a spaced apart manner, with intermediate spaces being provided between the tubes and filled with the drainage layer including slag granulate and a binder.

32. A collecting pit according to claim 31, wherein the tubes have upper ends which are covered by lids formed of a meltable material.

33. A collecting pit according to claim 1, wherein at least one drainage outlet is provided below the bottom of a reception part of the collecting pit for receiving molten metal, and at least one further drainage outlet is provided in a region of transition from an inlet part of the collecting pit into the reception part of the pit through which water coming from the inlet part is drained prior to reaching the reception part of the collecting pit.

* * * * *